US008458918B2

(12) United States Patent
Østberg

(10) Patent No.: US 8,458,918 B2
(45) Date of Patent: Jun. 11, 2013

(54) DRAWING DEVICE FOR CREATING MANDALA

(75) Inventor: Mette Østberg, Egaa (DK)

(73) Assignee: Ostberg Design APS, Egaa (DK)

( * ) Notice: Subject to any disclaimer, the term of this patent is extended or adjusted under 35 U.S.C. 154(b) by 0 days.

(21) Appl. No.: 13/450,584

(22) Filed: Apr. 19, 2012

(65) Prior Publication Data

US 2012/0210587 A1 Aug. 23, 2012

Related U.S. Application Data

(63) Continuation of application No. PCT/DK2010/000134, filed on Oct. 14, 2010.

(30) Foreign Application Priority Data

Oct. 19, 2009 (DK) ..... 2009 01132

(51) Int. Cl.
*B43L 13/00* (2006.01)

(52) U.S. Cl.
USPC ..... 33/562; 33/27.03

(58) Field of Classification Search
USPC ..... 33/562–566, 27.02, 27.03
See application file for complete search history.

(56) References Cited

U.S. PATENT DOCUMENTS

| | | | | | |
|---|---|---|---|---|---|
| 1,343,968 | A | * | 6/1920 | Hahn | 33/489 |
| 2,230,010 | A | * | 1/1941 | Owens | 33/489 |
| 2,950,537 | A | * | 8/1960 | Fixen | 33/565 |
| 3,738,010 | A | * | 6/1973 | Carder | 33/489 |
| 3,813,787 | A | | 6/1974 | Mercorelli | |
| 4,274,459 | A | * | 6/1981 | Galajda | 33/564 |
| 4,391,045 | A | | 7/1983 | Fisher | |
| 4,589,210 | A | * | 5/1986 | Konrad | 33/27.03 |
| 4,688,330 | A | * | 8/1987 | Konrad | 33/27.03 |
| 4,791,733 | A | * | 12/1988 | Pan et al. | 33/403 |
| 5,331,744 | A | | 7/1994 | Rumsey | |
| 5,390,418 | A | * | 2/1995 | Buono et al. | 33/27.03 |
| 5,396,713 | A | * | 3/1995 | Valdez | 33/565 |

(Continued)

FOREIGN PATENT DOCUMENTS

| | | |
|---|---|---|
| EP | 1108562 | 6/2001 |
| FR | 2091724 | 1/1972 |
| FR | 2893534 | 5/2007 |
| WO | WO2011/047678 | 4/2011 |

OTHER PUBLICATIONS

International Search Report for PCT Patent App. No. PCT/DK2010/000134 (Feb. 2, 2011).

*Primary Examiner* — Yaritza Guadalupe-McCall
(74) *Attorney, Agent, or Firm* — Cermak Nakajima LLP; Adam J. Cermak

(57) ABSTRACT

A drawing device for creating Mandala includes a single molded unit of a base plate, a support surface, and an outer frame, with the support surface being slightly recessed in relation to the bordering outer frame and the inner frame having the exact measurements of the support surface. The inner frame contains one or several voids within it and is positioned inside the outer frame on the drawing material lying on the support surface, and stencils(s) shaped to fit precisely into the matching void(s) of the inner frame can be positioned onto the drawing material lying on the support surface, allowing for the stencil to be rotated or mirrored repeatedly within the void of the inner frame while still maintaining its exact center point due to the void(s) and stencil(s) being non-circular, exhibiting at least at three edges.

8 Claims, 1 Drawing Sheet

U.S. PATENT DOCUMENTS 5,471,749 A * 12/1995 Brady ..... 33/484
5,577,328 A * 11/1996 Kerry, Sr. ..... 33/563
5,987,760 A * 11/1999 Hsu ..... 33/27.03
6,286,224 B1 * 9/2001 Lewis ..... 33/562
6,293,322 B1 * 9/2001 Wilson-South ..... 144/372
7,032,319 B2 * 4/2006 Ollgaard et al. ..... 33/483
7,185,441 B2 * 3/2007 Lockyer ..... 33/562
7,721,776 B2 * 5/2010 Justin ..... 144/144.51
7,958,646 B2 * 6/2011 So ..... 33/484
2003/0115767 A1 * 6/2003 Wedekind et al. ..... 33/566
2008/0022542 A1 * 1/2008 Brosmith et al. ..... 33/562
2012/0137532 A1 * 6/2012 Yeh ..... 33/562

* cited by examiner

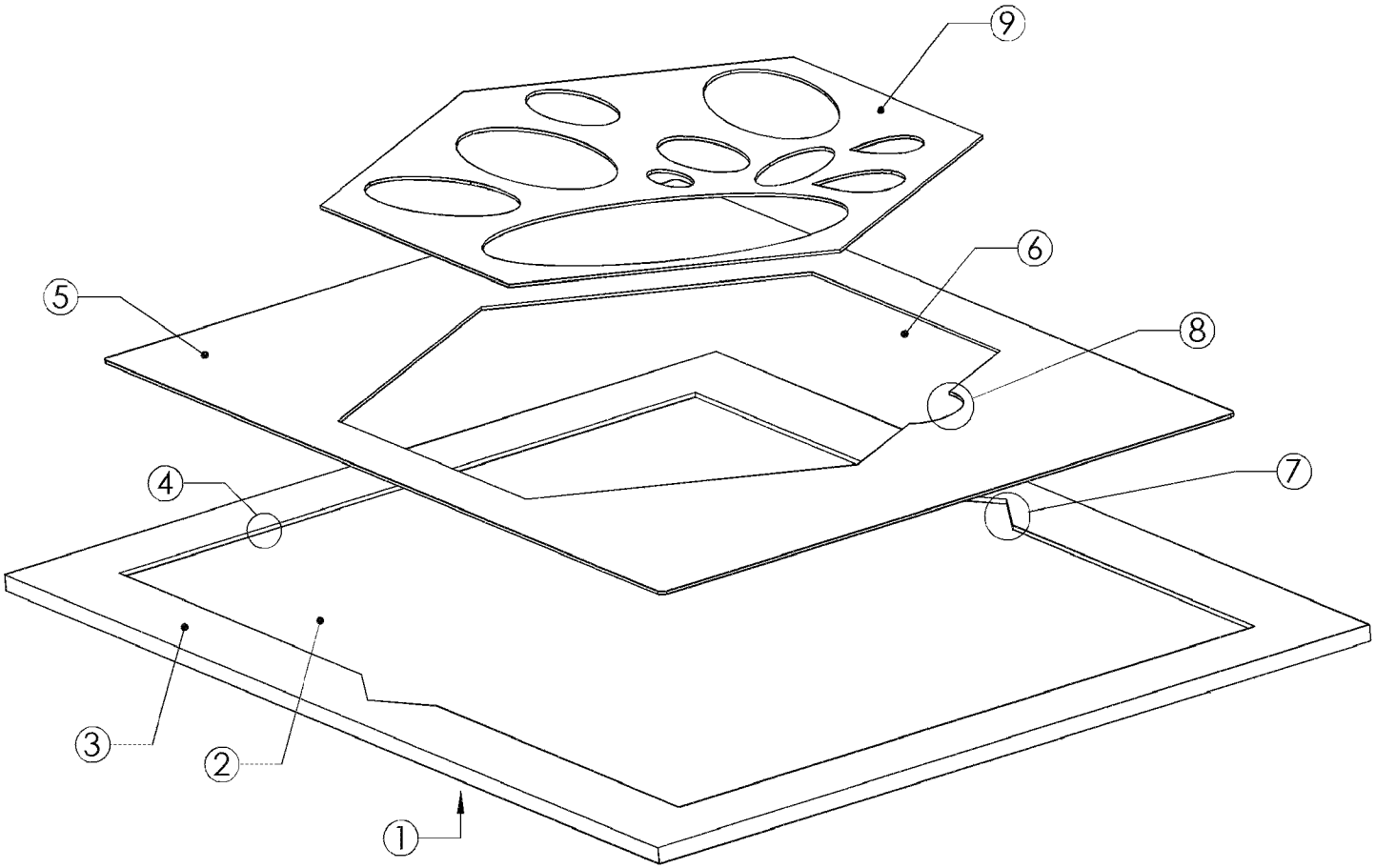
1
2
3
4
5
6
7
8
9

DRAWING DEVICE FOR CREATING MANDALA

This application is a Continuation of, and claims priority under 35 U.S.C. §120 to, International Application No. PCT/DK2010/000134, filed 14 Oct. 2010, which claims priority therethrough to Danish Application No. PA 2009 01132, filed 19 Oct. 2009, the entireties of which are incorporated by reference herein.

BACKGROUND

1. Field of Endeavor

This invention concerns a drawing device intended for, but not limited to, children over the age of 7 and adults which enables them to produce precise designs and, in particular, point-symmetrical patterns, known as Mandalas on standardized sized drawing material, particularly paper. This invention makes it possible to very easily produce simple as well as complicated symmetrical patterns and designs by combining, repeating and/or mirroring the shapes provided by the stencil.

2. Brief Description of the Related Art

Several drawing instruments have previously been developed in attempts to enable children to easily produce symmetrical designs.

EP1108562 provides for a drawing instrument which secures the drawing material with a slot in at least one corner region of the support surface. The template is round and rotatable about its central point while being guided by a template guide. It further provides for a central guide element designed as an axle stub which projects from the support surface with the template then being provided with a central opening with which it can be placed on the axle stub.

FR2893534 provides for a drawing instrument which consists of a circular plate with a bearing surface for the drawing material and an accessory frame which is placed upon the bearing surface providing for an inner periphery. The frame has a notching that operates with an accessory in notched discs so it is arranged in the inner periphery.

U.S. Pat. No. 4,391,045 provides for a drawing instrument or apparatus which consists of a frame having a circular opening and a multi-lobed cam-shaped recess and a disc with stencil shaped openings in its surface that has a multi-lobed cam-shaped external surface or edge. The disc is placed within the recess and by placing a writing instrument within the stencil opening and tracing along its outline the disc will move and a design is created.

Drawing devices embodying principles of the present invention are remarkable in their simplicity and the interaction between the inner and outer frame and the stencil(s), which together provide for very precise yet complicated patterns and designs to be easily created. Previous solutions do not provide for completely securing the drawing paper and the stencils will still be able to shift a little unlike those as described herein. Drawing devices as described herein invention can protect the drawing material not only from being shifted but also from being creased or wrinkled during the drawing process. Furthermore, the stencil and the drawing material can be removed from this drawing device and assembled again while still maintaining the same center point. The smooth, even and thin surface of the drawing device when assembled makes it very easy and comfortable for the user to rest his hands upon it. This combined with the drawing device allowing for the use of standardized pieces of paper makes this invention very user friendly for all ages.

SUMMARY

According to one embodiment of the present invention, a drawing device may include: a base plate, having a support surface for a sheet of drawing material; an outer frame, which borders an inner frame; and one stencil or more.

The support surface and the outer frame may be a single molded unit with the support surface being recessed in relation to the bordering outer frame, and the inner frame, having the exact measurements of the support surface while containing void(s) within to fit the stencil(s), is positioned inside the outer frame directly onto the drawing material lying on the support surface.

The stencil(s) being non-circular, exhibiting at least three edges and being shaped in such manner to fit precisely into the matching void(s) of the inner frame, may be positioned within the void(s) directly onto the drawing material lying on the support surface, and whether rotated or mirrored within the void(s) maintain same center point.

The outer frame may contain one or more small integrated cut out sections on one or more of its internal edges to provide easy access for a finger to grab/remove the inner frame.

The inner frame may have one or more small integrated cut out sections on one or more of its internal edges to provide easy access for a finger to grab/remove the stencil.

The outer frame, the inner frame, and the stencil(s) may be amounted to the same thickness when the inner frame is positioned on the support surface within the outer frame and the stencil(s) is positioned on the support surface within the inner frame.

The support surface may be custom-shaped according to the shape of the drawing material.

The single molded unit may comprise of base plate, support surface and the outer frame is provided with grip material underneath the base plate.

BRIEF DESCRIPTION OF THE DRAWING

The single drawing FIGURE is a diagram showing an exemplary embodiment according to the present invention.

DESCRIPTION OF EXEMPLARY EMBODIMENTS

Hereinafter, one embodiment of the present invention in the case where the present invention is applied, will be described with reference to the single drawing FIGURE.

In the following detailed description, only certain exemplary embodiment of the present invention is shown and described, by way of illustration. As those skilled in the art would recognize, the invention may be embodied in many different forms and should not be construed as being limited to the embodiments set forth herein.

The drawing FIGURE is a diagram showing an exemplary embodiment according to the present invention.

Referring to the FIGURE, a drawing device for creating Mandala according to the exemplary embodiment of the present invention includes a base plate (1), a support surface (2), an outer frame (3), an inner frame (5) and one or more stencils (9). The base plate (1), the support surface (2) and the outer frame (3) are a single molded unit with the support surface (2) being slightly recessed (4) in relation to the outer frame (3) which then borders the inner frame (5). The inner frame (5) has the exact measurements of the support surface (2) and it contains one or more voids (6) within. The inner frame (5) is positioned inside the outer frame (3) and onto the drawing material lying on the support surface (2). The stencil (9) is non-circular and exhibits at least three edges. The stencil (9) is shaped to fit precisely into the matching void of the inner frame (5) and is positioned within this void (6) and onto the drawing material lying on the support surface (2). The outer frame (3) contains one or more small integrated cut out sections (7) on one or more of its internal edges to provide easy access for a finger to remove the inner frame (5). Similarly, the inner frame (5) has one or more small integrated cut out sections (8) on one or more of its internal edges to provide easy access for a finger to grab/remove the stencil (9). When the inner frame (5) and the stencil (9) are positioned on the drawing material lying on the support surface (2), preferably they are amounted to the same thickness as the outer frame (3) as they are the same thickness as the recess (4) which exists between the outer frame (3) and the support surface (2).

The support surface (2) is custom-shaped to fit standardized sized drawing material, particularly pieces of paper, and the single molded unit is provided with grip material underneath the base plate (1).

The drawing device according to principles of the present invention illustrated in the FIGURE for creating Mandala provides for the drawing material and the stencil(s) (9) to be securely fastened, yet easily removed, and prevents both the drawing material and the stencil(s) (9) from any moving/sliding due to the interaction between the single molded unit, the inner frame (5) and one or more stencils (9). The outer frame (3) secures the inner frame (5) due to the inner frame (5) being the exact measurements of the support surface (2) which is slightly recessed in relation to the outer frame (3), and the inner frame (5) secures both the drawing material and the stencil(s) with the stencil(s) (9) being the exact size and shape of the void(s) (6) within the inner frame. This, combined with both the inner frame (5) and the stencil(s) (9) being applied directly to the drawing material lying on the support surface (2), also protects the drawing material from being creased, wrinkled or torn when designing the patterns and/or being removed from the drawing device. The stencil(s) (9) being non-circular makes it possible to ensure that they do not move or shift at all when being used. Due to the small integrated cut outs (7) and (8) on the edges of both the outer frame (3) and the inner frame (5), allowing for a finger to easily grab either the inner frame (5) or the stencil (9), it is very simple for even a child to combine, separate and re-combine the elements described. The stencil(s) (9) can now easily be lifted up and rotated or mirrored repeatedly while still maintaining its exact center point.

When the inner frame (5) is positioned within the outer frame (3) on the support surface (2) and the stencil (9) is positioned within the void (6) of the inner frame (5) on the support surface (2), preferably they are amounted to the exact thickness of the outer frame (3) thus making it very easy and comfortable for the user to rest the hand which holds the pen on the drawing device. This, combined with the base plate (1) having gripped the drawing material underneath, the drawing device is prevented from slipping without the user having to secure it either by hand or other means.

More specifically, the present invention is not limited to the above embodiment, and can be modified variously within the range shown in the claims. Embodiments obtained by combining technical means appropriately modified within the range shown in the claims also are included in the technical range of the present invention.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A drawing device useful for producing point-symmetrical patterns, including mandalas, said drawing device comprising:

a base plate having a support surface for a sheet of drawing material;

an inner frame;

an outer frame which borders the inner frame;

at least one stencil;

wherein the base plate, the support surface, and the outer frame are a single molded unit with the support surface being recessed in relation to the outer frame;

wherein the inner frame has the exact measurements of the support surface and is positioned inside the outer frame directly onto drawing material when lying on the support surface; and wherein the at least one stencil comprises a stencil with a polygonal shape, and the inner frame contains at least one void with a polygonal shape adapted to fit said stencil with a polygonal shape, such that whether rotated or mirrored within the at least one void of the inner frame, said stencil maintains the same center point.

2. The drawing device according to claim 1, wherein the polygonal stencil is non-circular with at least three edges and is shaped to fit precisely into the at least one void of the inner frame, and the polygonal stencil is adapted to be positioned within the at least one void directly onto the drawing material when lying on the support surface.

3. The drawing device according to claim 1, wherein the outer frame comprises at least one small integrated cut out sections on at least one internal edge, configured and arranged to provide easy access for a finger to grab/remove the inner frame.

4. The drawing device according to claim 1, wherein the inner frame has at least one small integrated cut out section on at least one internal edge, configured and arranged to provide easy access for a finger to grab/remove the stencil.

5. The drawing device according to claim 1, wherein the outer frame, the inner frame, and the at least one stencil have the same thickness, when the inner frame is positioned on the support surface within the outer frame and the at least one stencil is positioned on the support surface within the inner frame.

6. The drawing device according to claim 1 useful with drawing material having a predetermined shape, wherein the support surface is custom-shaped according to said predetermined shape of the drawing material.

7. The drawing device according to claim 1, wherein said single molded unit comprises grip material underneath the base plate.

8. A drawing device comprising:

a base plate having a support surface for a sheet of drawing material;

an inner frame;

an outer frame which borders the inner frame;

at least one stencil separate from said inner frame;

wherein the base plate, the support surface, and the outer frame are a single molded unit with the support surface being recessed in relation to the outer frame;

wherein the inner frame has the exact measurements of the support surface and is positioned inside the outer frame directly onto drawing material when lying on the support surface; and wherein the at least one stencil comprises a stencil with an outer polygonal shape, and the inner frame contains at least one inner void with a polygonal shape adapted to exactly fit said stencil outer polygonal shape.

* * * * *